United States Patent [19]

Scozzafava et al.

[11] Patent Number: 4,944,620

[45] Date of Patent: Jul. 31, 1990

[54] PRINTER DEVICE FOR DUPLICATE SLIPS AND THE LIKE

[75] Inventors: Milton Scozzafava, Rowland Heights; John G. Clary, Pasadena, both of Calif.

[73] Assignee: Addmaster Corporation, Monrovia, Calif.

[21] Appl. No.: 390,636

[22] Filed: Aug. 7, 1989

[51] Int. Cl.[5] ..... B41J 11/50

[52] U.S. Cl. ..... 400/608.1; 400/607; 400/636; 400/641; 271/125; 271/149

[58] Field of Search ..... 400/605, 607, 608, 608.1, 400/608.3, 608.4, 624, 629, 636, 636.1, 637.1, 641; 271/251, 149, 31.1, 121, 124, 125

[56] References Cited

U.S. PATENT DOCUMENTS

| | | | |
|---|---|---|---|
| 4,229,113 | 10/1980 | Anderson et al. . | |
| 4,431,179 | 2/1984 | Westover et al. | 271/31.1 |
| 4,458,890 | 7/1984 | Kawazu | 271/121 |
| 4,506,878 | 3/1985 | Bashford | 271/251 |
| 4,533,270 | 8/1985 | Shimizu | 400/636 |
| 4,577,984 | 3/1986 | Yamamoto . | |
| 4,664,252 | 5/1987 | Galbraith | 271/31.1 |
| 4,707,159 | 11/1987 | Hirano et al. . | |

FOREIGN PATENT DOCUMENTS

| | | | |
|---|---|---|---|
| 57-62139 | 4/1982 | Japan | 271/251 |

*Primary Examiner*—Edgar S. Burr
*Assistant Examiner*—Ren Yan
*Attorney, Agent, or Firm*—Fred N. Schwend

[57] ABSTRACT

A printer for printing data on an original slip and on a copy slip in which both are dropped into a guide chute. Feed and pinch rollers having a higher degree of friction that the friction between the slips tend to drive both slips along the chute and past an ink jet printer. However, a brake initially prevents rotation of the pinch roller and thus retains one of the slips while the other slip is advanced past the printer, at which time the brake is released to enable the feed roller to advance the remaining slip past the printer.

9 Claims, 3 Drawing Sheets

PRINTER DEVICE FOR DUPLICATE SLIPS AND THE LIKE

BACKGROUND OF THE INVENTION

1. Field of the Invention

This invention relates to printers and has particular reference to a printer for printing data on an original slip or sheet and similar data on a copy slip or sheet.

2. Description of the Prior Art

In many business applications duplicate records are made of transactions and the like. For example, in banking applications, duplicate record slips are printed with the amount of a customer's deposit, etc., one slip being given to the customer and the other retained by the bank for processing and record keeping.

For this purpose, such duplicate slips are generally printed by using an impact printer which prints against a pair of superimposed slips placed within a holder with an interleaved carbon paper therebetween or with the facing surfaces of the slips chemically treated to transfer an imprint from one slip to the other.

Although such previous printing systems are generally satisfactory, they require the use of impact printers which create considerable noise. Also, carbon paper and chemically treated papers are much more expensive than plain paper when large numbers of slips are printed. Further, since the printing impact must be transmitted through one of the slips to the other, the quality of printing on the second slip is degraded appreciably, particularly when relatively thick paper is used.

SUMMARY OF THE INVENTION

It therefore becomes a principal object of the invention to provide a noiseless printing system for printing data on an original slip and on a copy slip without requiring an impact printer.

Another object is to provide a printing system for printing duplicate record slips which does not require interleaved carbon paper or chemically treated paper.

Another object is to reduce the cost of printing duplicate slips and the like.

Another object is to provide a printing system for printing an original and a copy slip in which paper of any desired thickness may be used.

Another object is to provide a simple, compact and inexpensive printer for printing data on an original and on a copy slip or sheet.

According to the invention, a guide chute is provided into which a pair of slips of paper of any desired thickness are dropped while in contact with each other and a sensor causes a pinch roller, under control of a suitable data processor, to press the slips against a rotating feed roller. Such rollers have considerably greater frictional gripping characteristics than the frictional gripping characteristics existing between the slips.

Initially, the processor controls a brake to prevent rotation of the pinch roller and, accordingly, the feed roller advances a first one only of the slips along the chute and past a serially operable printer to print a line of data thereon under control of the processor.

As the first slip moves past the printer and into a stacking portion of the guide chute, a second sensor causes the brake to release the pinch roller, enabling the feed roller to advance the second slip past the printer which is again controlled by the processor to print a duplicate record on the second slip. Additional data or different data may also be printed on the second slip.

An important feature of the invention is that the slips do not have to be dropped at a precise location in the chute. Nor do they have to be aligned lengthwise with each other in order for the printing to be impressed at precise locations on both slips. This relieves the operator of the tedious task of aligning the slips with each other and with the printer preparatory to printing. Also, slips of different sizes may be printed.

BRIEF DESCRIPTION OF THE DRAWINGS

The manner in which the above and other objects of the invention are accomplished will be readily understood on reference to the accompanying drawings when read in conjunction with the following specification, in which.

DESCRIPTION OF THE PREFERRED EMBODIMENT

Figure 1:
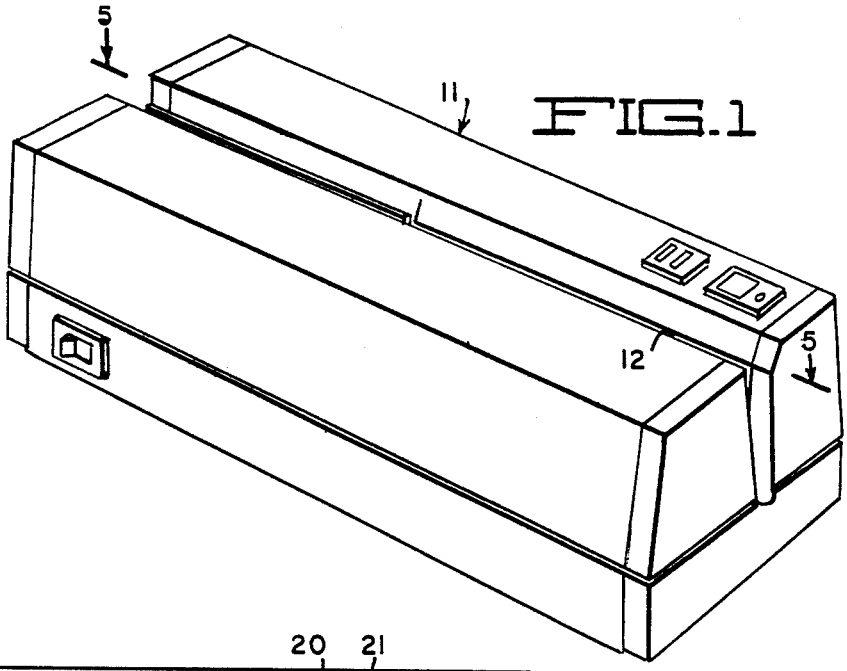
FIG. 1 is a perspective view of a printer embodying a preferred form of the present invention.
Figure 3:
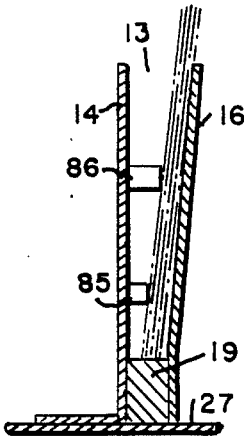
FIG. 3 is a transverse section view taken along line 3—3 of FIG. 5.
Figure 4:
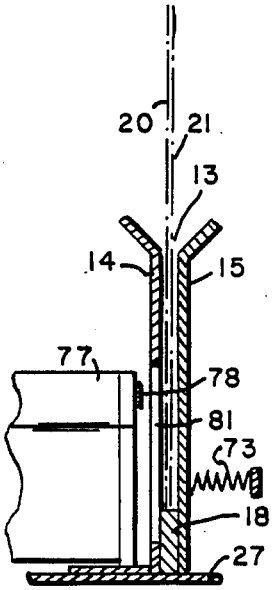
FIG. 4 is a transverse section view taken along line 4—4 of FIG. 5.
Figure 5:
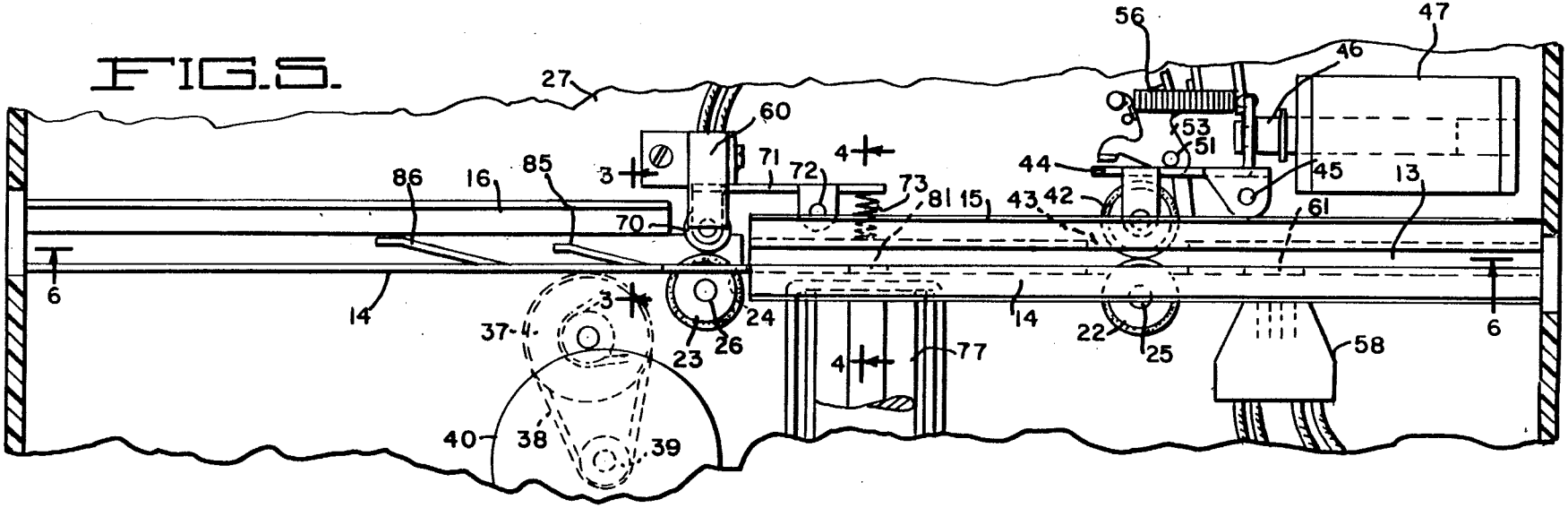
FIG. 5 is a sectional plan view taken substantially along line 5—5 of FIG. 1.
Figure 6:
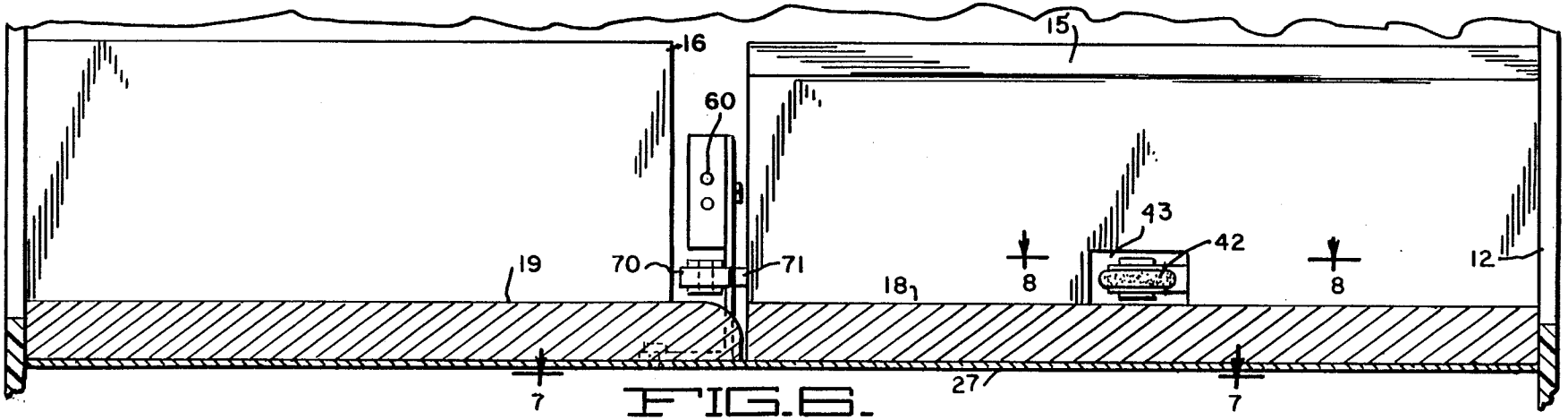
FIG. 6 is a sectional elevation view taken along line 6—6 of FIG. 5.

Referring to the drawings, the printer is housed in a casing 11 (FIG. 1) having a longitudinally extending slot 12 which overlies a chute 13 (FIGS. 3, 4 and 5) formed by a forward wall 14 and two coextensive rear walls 15 and 16. The wall 15, along with the right hand portion of wall 14, forms an insertion chute section and the wall 16, along with the left hand portion of wall 14, forms a stacking chute portion. The chute also includes spacers 18 and 19 which form bottom slip guides and also space the walls apart.

Figure 2:
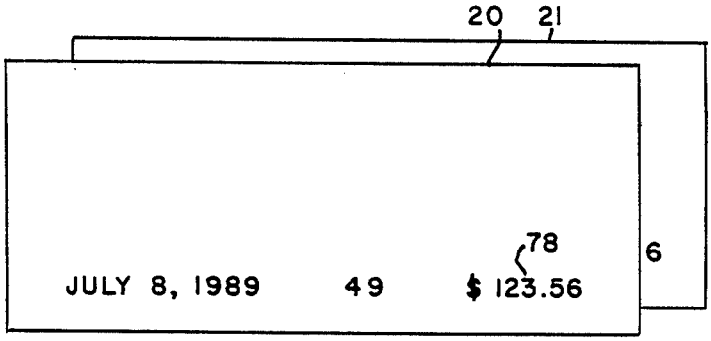
FIG. 2 is a face view of a typical pair of slips printed by the printer.
Figure 7:
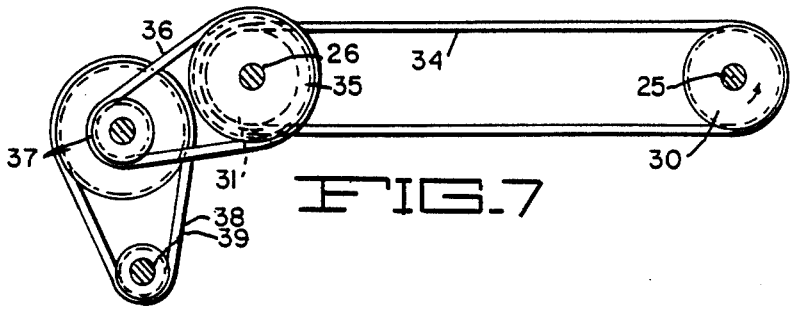
FIG. 7 is a sectional plan view taken along line 7—7 of FIG. 6.

Paper slips or other record mediums, such as shown at 20 and 21 (FIG. 2), to be printed, are dropped in contact with each other into the insertion chute section. A pair of feed rollers 22 and 23 are spaced along the chute and project partly through openings 24 in the chute wall 14. Such rollers have relatively soft tires 251, such as rubber O-rings, mounted on their peripheries, forming frictional surfaces of greater frictional characteristics than the frictional relationship between the two slips. The rollers 22 and 23 are continuously rotated and for this purpose, shafts 25 and 26 ,respectively, thereof are rotatably mounted in bearings in the base plate 27 to which casing 11 is attached. Pulleys 30 and 31 (FIG. 7) on shafts 25 and 26, respectively are continuously rotated by a drive system including a belt 34, pulley 35 integral with pulley 31, belt 36, compound pulley 37, belt 38 and pulley 39 of a drive motor 40 (FIG. 5) suitably attached to the base plate 27.

A pinch roller 42 (FIGS. 5, 6, 8 and 9) is extendable into an opening 43 in chute wall 15 and is rotatably carried by an arm 44 pivoted on a frame stud 45 and urged counter clockwise by a tension spring 56 to urge the pinch roller 42 into contact with the feed roller 22 or any paper slips therebetween. A soft frictional tire 147, similar to tire 251, is mounted on the periphery of roller 42.

The arm 44 is pivotally connected to the armature 46 of a solenoid 47 suitably supported by the base plate 27.

Figure 9:
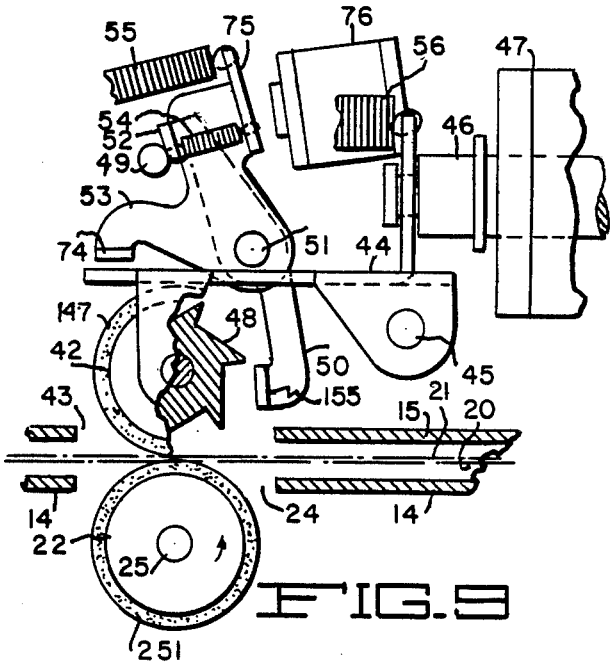
FIG. 9 is a sectional plan view similar to FIG. 8 but showing parts thereof in an alternate position.

Pinch roller 42 is integral with a star wheel 48 adapted to be arrested by a brake pawl 50 forming a brake for roller 42. Pawl 50 is pivoted on a frame stud 51 and has an ear 52 normally engaged with an armature lever 53 independently pivoted on the stud 51. A light tension spring 54 normally holds the ear 52 of pawl 50 in engagement with lever 53 so that they normally pivot as a unit while a tension spring 55 urges the pawl and lever toward a counterclockwise rocked position where the pawl 50 limits against a frame stud 49 as shown in FIG. 9. In such case, a stop ear 155 on pawl 50 lies out of blocking engagement with the star wheel 48.

A pinch roller 70 (FIGS. 5 and 6) having a relatively smooth and non-frictional periphery is provided to continually press any slips being fed into the stacking chute section, against drive roller 23 for the purpose of advancing slips from the insertion chute section into the stacking chute section. For this purpose, roller 70 is rotatably carried by an arm 71 pivoted on a frame stud 72 and urged counterclockwise by a compression spring 73.

Figure 10:
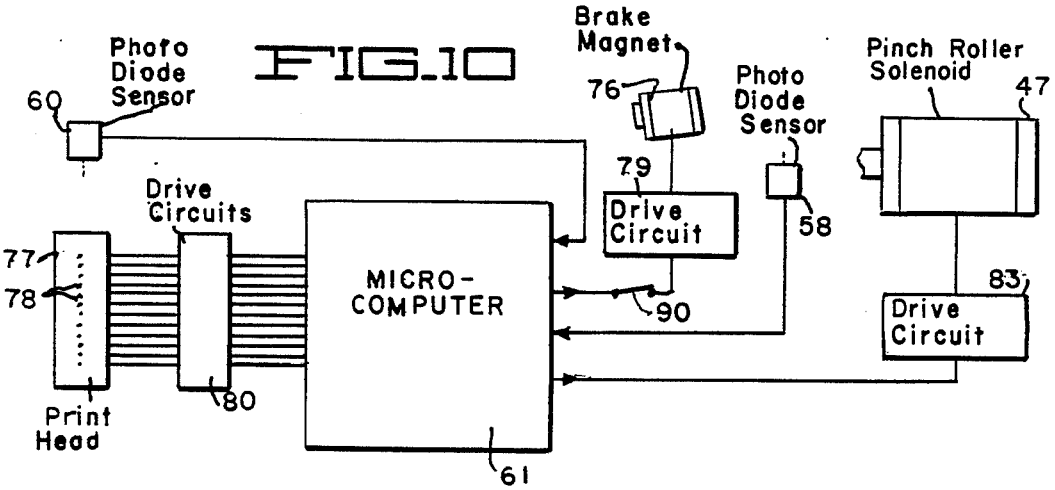
FIG. 10 is a block diagram of the electrical controls for the system.

A pair of conventional light sensing devices 58 and 60, such as photo diodes, are spaced along the chute 13 and are suitably supported by the base plate 27 in positions to transmit signals to a micro-computer 61 (FIG. 10) or other data processing device when a slip or slips advancing in the chute 13 pass thereby.

The sensing device 58 is located substantially midway along the insertion chute section and opposite an opening 61 in the chute wall 14. It is also located adjacent the bottom of the chute 13 to transmit a signal to the computer 61 when one or more slips are dropped into the chute. Sensing device 60 is located between the insertion and stacking chute sections and in line with feed roller 23 to transmit a signal to computer 61 when the leading and trailing edges of either slip pass into the stacking chute section.

Figure 8:
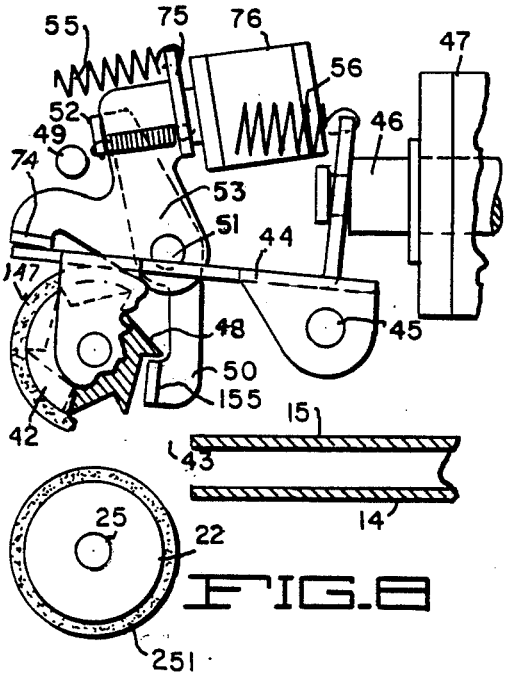
FIG. 8 is an enlarged sectional plan view taken along line 8—8 of FIG. 6.

Normally, when no slips are present in the insertion chute section, computer 61 applies a signal through drive circuit 83 to energize solenoid 47 causing arm 44 to assume its clockwise rocked position shown in FIG. 8, thereby holding pinch roller 42 out of engagement with feed roller 22. Also, at this time, arm 44 engages an ear 74 on lever 53, thus rocking lever 53 and brake pawl 50 clockwise into braking relation with star wheel 48. Also, at this time, an ear 75 on lever 53 acts as an armature to engage the pole piece of an electromagnet 76 supported by base plate 27. When a signal is applied to the magnet 76 from the computer 61, the magnet will be effective to hold stop pawl 50 in its braking position of FIG. 8 even when solenoid 47 is deenergized to allow spring 56 to move pinch roller 42 to its position of FIG. 9, as will be described later.

A serially operable ink jet printer 77 (FIGS. 4, 5 and 10) is provided to form a line of print, i.e., 78 (FIG. 2), on a slip advancing along chute 13. One such printer is available from the Hewlett Packard company of Palo Alto, Calif., Part No. 92261A, and generally comprises a body supported by the base plate 27 and having a series 78 of vertically aligned minute ink jet nozzles individually controlled by the computer 61 to impel minute globules of ink through an opening 81 in chute wall 14 and against a forwardly located slip in the chute.

OPERATION

When a pair of slips, i.e., 20 and 21, are dropped into the insertion chute portion, they activate sensing device 58, causing computer 61 to signal driver circuit 83 to deenergize solenoid 47, enabling spring 56 to move pinch roller 42 to press the inserted slips into engagement with drive roller 22. Simultaneously, or slightly prior thereto, computer 61 will signal a drive circuit 79 to energize magnet 76 to hold stop pawl 50 in its braking position of FIG. 8. Accordingly, since the friction between the slips is less than the friction between each of the rollers 22, 42 and its respectively engaged slip, the forward slip, i.e., 20 will be advanced along the chute 13 and past printer 77 while the rear slip will be restrained by the friction between it and pinch roller 42.

As the forward slip moves into the stacking chute section, the drive roller 23 will continue to advance it even as it passes from engagement with feed roller 22. As the trailing edge of such forward slip passes the sensing device 60 the latter will transmit a signal to the computer 61 which, through drive circuit 79, will cause deenergization of brake magnet 76, allowing spring 55 to retract brake pawl 50 thereby freeing the pinch roller 42 to rotate and permitting feed roller 22 to advance the remaining slip past the printer 77. The computer will then cause a duplicate printing action to occur, although it could also be programmed to print additional or other data, if desired. As the trailing edge of the second slip passes the sensing device 60, a signal is transmitted to the computer 61 causing it to again effect energization of solenoid 47 to retract pinch roller 42 to enable insertion of an additional pair of slips.

In the event that it is desired to print only a single slip, the drive circuit 79 is deactivated as by opening a switch 90 to prevent braking of pinch roller 42 by brake pawl 50.

It will be noted that the rear chute wall 16 (FIGS. 3 and 5) is inclined upwardly and is spaced rearwardly somewhat from the plane of the rear chute wall 15. As each slip advances into the stacking chute section it engages a deflecter 85 extending from the chute wall 14, causing it to be shifted rearwardly toward wall 16 and to recline against the latter wall, thus leaving space for the next slip to pass into the stacking section. As the slip moves further into the stacking section it engages a second deflector 86 which further deflects it rearwardly out of the path of an incoming slip.

It will be seen from the foregoing that we have provided an extremely simple, compact, inexpensive and noiseless printer for printing data on an original slip and on a copy slip without requiring a carbon paper, etc., and without degrading the quality of print on either slip. Also, the printer permits easy and rapid handling of such slips since they do not have to be tediously aligned with each other or aligned with the feed roller 22 during insertion into the chute but may be dropped haphazardly therein while the resulting printing will be precisely located on both slips. Further, slips of various thicknesses may be used without affecting the quality of printing on either slip.

We claim:

1. A printer for printing data on each of a pair of superimposed record mediums comprising the combination of a printing device, means for guiding said mediums past said printing device, a feed roller, means for rotating said feed roller, a pinch roller for pressing said mediums into engagement with each other and with said feed roller, said rollers having greater frictional gripping characteristics than the frictional gripping characteristics of said mediums with each other, a braking device coupled to said pinch roller, means for (preventing) enabling said braking device whereby to prevent rotation of said pinch roller whereby (prevent) to enable said feed roller to advance one only of said mediums past said printing device, and means for thereafter (enabling) disabling said braking device to enable said feed roller to advance the other of said mediums past said printing device.

2. A printer as defined in claim 1 wherein said guiding means comprises a guide chutes, means for holding said pinch roller out of engagement with said mediums, and means responsive to presence of said mediums in said chute for disabling said holding means.

3. A printer as defined in claim 1 wherein said last mentioned means comprises means for sensing at least one of said mediums upon advancement thereof past said printing device.

4. A printer for printing data on each of a pair of record mediums comprising the combination of a printing device, means for guiding said mediums past said printing device, a feed roller, means for rotating said feed roller, a pinch roller adapted to press said mediums into engagement with each other and with said feed roller, said rollers having greater frictional gripping characteristics than the frictional gripping characteristic of said mediums with each other, means for holding said pinch roller out of engagement with said mediums, means operable by said holding means for preventing rotation of said pinch roller, and means responsive to a predetermined movement of one of said mediums past said printing device for disabling said rotation preventing means.

5. A printer as defined in claim 4 wherein said feed roller is located upstream from said printing device, and means upstream from said feed roller for sensing the presence of said mediums in said guide means and for actuating said disabling means.

6. A printer as defined in claim 4 wherein said holding means comprises electromagnetic means, spring means for moving said pinch roller to engage said mediums with said feed roller, means including a sensing device located upstream from said printing device for sensing the presence of said mediums in said guide means and for deenergizing said electromagnetic means, second electromagnetic means for actuating said holding means to prevent rotation of said pinch roller, and means including a second sensing device located downstream from said printing device for disabling said rotation preventing means.

7. A printer as defined in claim 4 comprising means for selectively disabling said rotation preventing means.

8. A printer for printing data on each of a pair of superimposed record mediums comprising the combination of a printing device, a chute for guiding said mediums past said printing device, said chute having a first wall, a feed roller, means for rotating said feed roller, a pinch roller for yieldably pressing said mediums into frictional gripping engagement with said feed roller, the frictional engagement of said rollers with respective ones of said mediums being greater than the frictional engagement said mediums with each other, means for braking said pinch roller whereby to enable said feed roller to advance one only of said mediums toward one end of said chute and past said printing device, means for thereafter releasing said braking means whereby to enable said feed roller to advance the other of said mediums toward said one end of said chute and past said printing device, said chute having a second wall at said one end of said chute, said second wall being located in a plane spaced rearwardly from the plane of said first wall and inclined rearwardly relative to said first wall, and means for deflecting a said medium toward said second wall after passing said first wall.

9. A printer as defined in claim 8 comprising a second feed roller downstream of said printing device, means for rotating said second feed roller, and a second pinch roller for pressing said mediums against said second feed roller.

* * * * *

UNITED STATES PATENT AND TRADEMARK OFFICE

CERTIFICATE OF CORRECTION

PATENT NO. : 4,944,620

DATED : July 31, 1990

INVENTOR(S) : M. Scozzafava, et al

It is certified that error appears in the above-identified patent and that said Letters Patent is hereby corrected as shown below:

Claim 1, line 15, cancel "preventing"
line 17, cancel "prevent"
line 20, cancel "enabling"

Signed and Sealed this

Seventeenth Day of December, 1991

*Attest:*

HARRY F. MANBECK, JR.

*Attesting Officer*

*Commissioner of Patents and Trademarks*